US007299599B2

(12) United States Patent
Swann

(10) Patent No.: US 7,299,599 B2
(45) Date of Patent: Nov. 27, 2007

(54) ROOFING COMPONENT ADHERING ASSEMBLY AND METHOD

(75) Inventor: Raymond C. Swann, Kansas City, MO (US)

(73) Assignee: Johns Manville, Denver, CO (US)

( * ) Notice: Subject to any disclaimer, the term of this patent is extended or adjusted under 35 U.S.C. 154(b) by 99 days.

(21) Appl. No.: 11/235,989

(22) Filed: Sep. 26, 2005

(65) Prior Publication Data

US 2006/0035048 A1 Feb. 16, 2006

Related U.S. Application Data

(62) Division of application No. 10/449,780, filed on May 30, 2003, now Pat. No. 6,962,738.

(51) Int. Cl.
*E04B 1/00* (2006.01)
*E04G 21/00* (2006.01)
*E04G 23/00* (2006.01)

(52) U.S. Cl. ..... 52/746.11; 52/746.1; 52/412; 52/408; 52/748.1

(58) Field of Classification Search ..... 52/746.11, 52/746.1, 745.21, 408, 412, DIG. 16, 309.8, 52/551, 748.1; 156/71, 91, 92
See application file for complete search history.

(56) References Cited

U.S. PATENT DOCUMENTS 2,863,405 A * 12/1958 Liebrook et al. ..... 52/420
3,434,259 A * 3/1969 Corbin ..... 52/420
4,091,135 A * 5/1978 Tajima et al. ..... 428/40.3
4,348,440 A * 9/1982 Kriozere ..... 428/42.2
4,757,652 A * 7/1988 Kalkanoglu ..... 52/420
4,885,887 A * 12/1989 Simmons et al. ..... 52/410
5,687,517 A * 11/1997 Wiercinski et al. ..... 52/177
6,148,578 A * 11/2000 Nowacek et al. ..... 52/518
6,360,506 B1 * 3/2002 Graae ..... 52/408
6,378,259 B1 * 4/2002 Carlson ..... 52/408
6,696,125 B2 * 2/2004 Zanchetta et al. ..... 428/40.1
6,701,685 B2 * 3/2004 Rippey ..... 52/408
7,178,306 B2 * 2/2007 Fritz ..... 52/746.11

* cited by examiner

*Primary Examiner*—Richard E. Chilcot, Jr.
*Assistant Examiner*—Chi Q. Nguyen
(74) *Attorney, Agent, or Firm*—Robert D. Touslee

(57) ABSTRACT

A roofing component adhering assembly includes a bitumen layer having first and second major surfaces and at least a first release sheet substantially coextensive with the first major surface of the bitumen layer. The first release sheet is separable from the first major surface of the bitumen layer so that the bitumen layer of the roofing component adhering assembly can be used to adhere together overlapping surfaces, such as end and/or lateral edge portions, of first and second roofing components. The roofing component adhering assembly is especially well suited for adhering surfaces together where one of the surfaces is a granule surface, such as an end edge portion of a cap sheet. Preferably, styrene-butadiene-styrene modified bitumen is used to form the bitumen layer.

7 Claims, 3 Drawing Sheets

FIG. 1
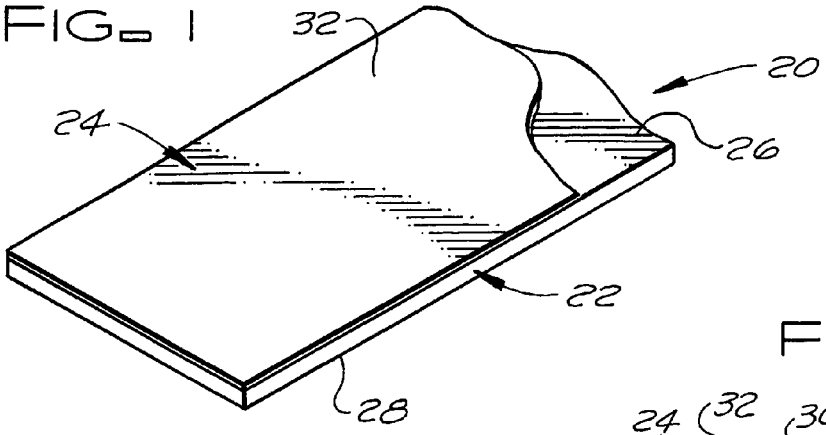
FIG. 3
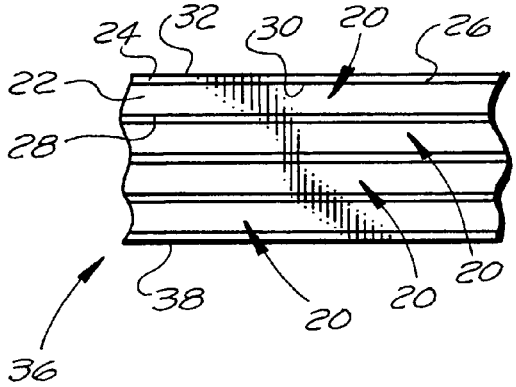
FIG. 2
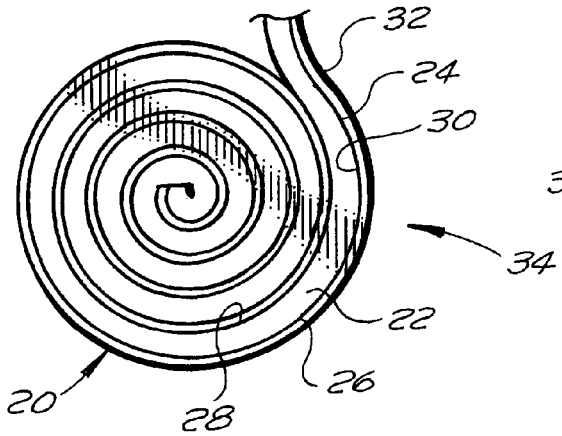
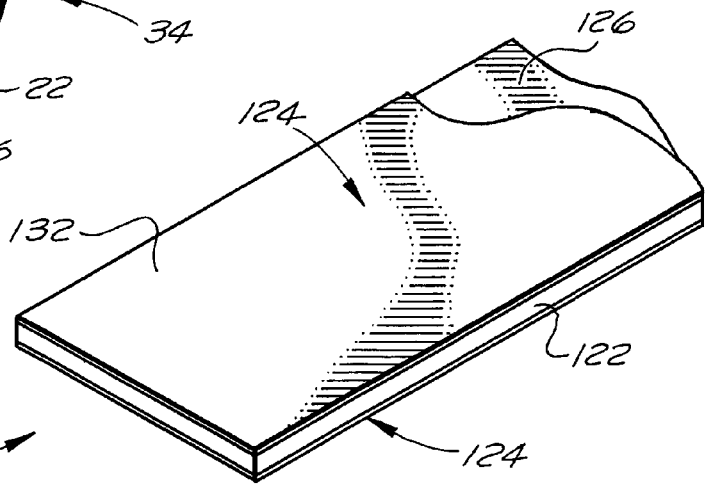
FIG. 4
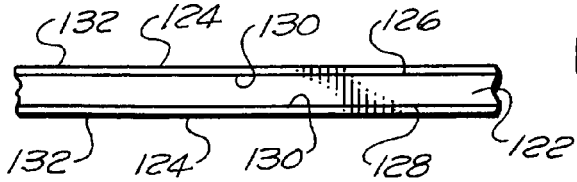
FIG. 5

ROOFING COMPONENT ADHERING ASSEMBLY AND METHOD

This application is a divisional application of Ser. No. 10/449,780 filed May 30, 2003 now U.S. Pat. No. 6,962,738

BACKGROUND OF THE INVENTION

The subject invention relates to an assembly for and method of adhering together surfaces of roofing components and is especially well suited for adhering together overlapping edge portions of roofing components to form a watertight, weather-secure seam even when the surface of one of the overlapping edge portions is a granule surface. It is also suitable for adhering insulation to decks, insulation to insulation, and cover boards to insulation.

Built-up roofing systems typically include cap sheets and/or other roofing sheet components that must be adhered to underlying layers of the built-up roofing system and that have overlapping edge portions that must be adhered together to form watertight, weather-secure seams. One example of these built-up roofing systems is a roofing system that utilizes self-adhering cap sheets. The lower major surfaces of these cap sheets have a self-adhering adhesive thereon that is used to adhere these cap sheets to granule free surfaces of other cap sheets and other roofing sheets. Typically, the upper major surfaces of these cap sheets are granule surfaced except for granule free lateral edge portions that, when the cap sheets are installed, are overlapped by and adhered to the lower lateral edge portions of adjacent cap sheets. The upper major surfaces of these cap sheets also have end edge portions that are granule surfaced. Thus, when the end edge portions of two cap sheets are overlapped, the upper surface of the underlying end edge portion of one cap sheet that is to be adhered to the lower surface of the end edge portion of the other cap sheet is a granule surface. Currently, the self-adhering adhesive on the lower major surfaces of these cap sheets does not form a watertight, weather-secure seam between the lower surface of the end edge portion of the one cap sheet and the granule covered upper surface of the end edge portion of the other cap sheet and the seams between the end edge portions of the cap sheets must be formed by heat welding techniques, the application of hot asphalt, or the application of liquid adhesives. Thus, there has remained a need for a quick, easy to use, economical, and effective way to form a watertight, weather-secure seam between the end edge portions of cap sheets that does not require the use of heat welding techniques, the application of hot asphalt, or the application of liquid adhesives.

SUMMARY OF THE INVENTION

The roofing component adhering assembly and method of the subject invention provide a quick, easy to use, economical, and effective way to form a watertight, weather-secure seam between the end edge portions of cap sheets that does not require the use of heat welding techniques, the application of hot asphalt, or the application of liquid adhesives. In addition, to bonding roofing component surfaces together where at least one of the surfaces is a granule surface, the roofing component adhering assembly and method of the subject invention can also be used to form watertight, weather-secure seams between the granule free lateral edge portions of cap sheets and other roofing sheet components and to otherwise adhere roofing sheet components to underlying layers of a roofing system. In addition, the subject invention can also be used to form water tight, weather secure bonds between insulating materials, cover boards and insulating materials, insulation materials and roof decks.

The roofing component adhering assembly of the subject invention includes a bitumen layer having first and second major surfaces and at least a first release sheet substantially coextensive with the first major surface of the bitumen layer. The first release sheet is separable from the first major surface of the bitumen layer so that the bitumen layer of the roofing component assembly can be located between and used to adhere together overlapping surfaces of first and second roofing components (such as end and/or lateral edge portions of first and second roofing components). When the roofing component adhering assemblies of the subject invention are packaged in roll form or stacks, one surface of the first release sheet may be more easily separable from the bitumen layer than the other surface of the first release sheet to facilitate the dispensing of roofing component adhering assemblies from the roll or stack. Some embodiments of the roofing component adhering assembly may also include a second release sheet that is substantially coextensive with and separably adhered to the second major surface of the bitumen layer. The roofing component adhering assembly of the subject invention is especially well suited for adhering surfaces together to form a watertight, weather-secure seam where one of the surfaces is a granule surface, such as an end edge portion of a cap sheet. Preferably, styrene-butadiene-styrene modified bitumen is used to form the bitumen layer.

BRIEF DESCRIPTION OF THE DRAWINGS

FIG. 1 is a partial schematic perspective view of a first roofing component adhering assembly of the subject invention.

FIG. 2 is a partial schematic side view of a roll of the roofing component adhering assembly of FIG. 1.

FIG. 3 is a partial schematic side view of a stack of the roofing component adhering assemblies of FIG. 1.

FIG. 4 is a partial schematic perspective view of a second roofing component adhering assembly of the subject invention.

FIG. 5 is a partial schematic side view of the roofing component adhering assembly of FIG. 4.

DESCRIPTION OF THE PREFERRED EMBODIMENTS

Figure 6:
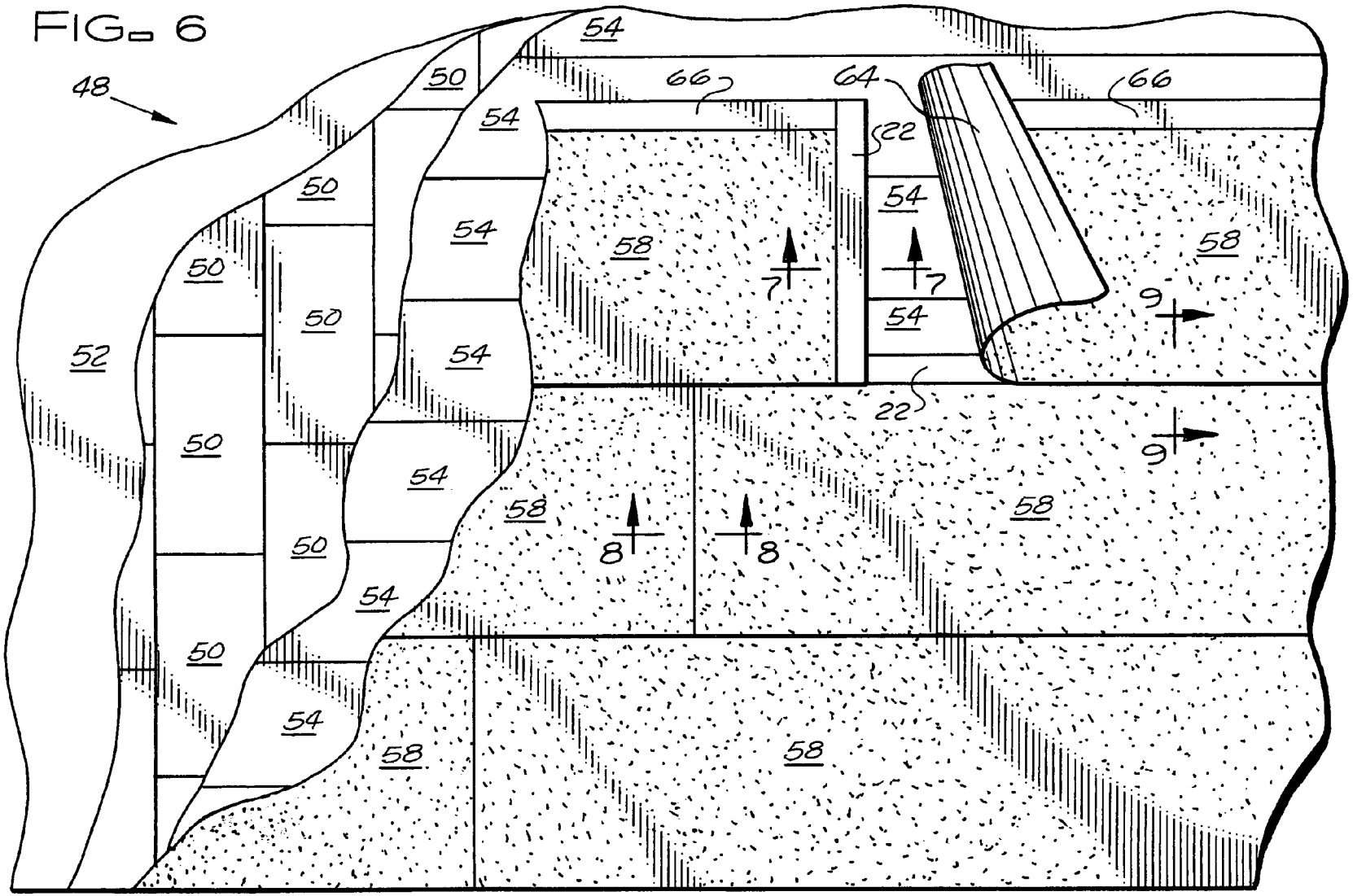
FIG. 6 is a partial schematic plan view of a roofing system utilizing the roofing component adhering assembly of the subject invention.

The roofing component adhering assembly 20 of FIG. 1 includes a bitumen layer 22 and a release sheet 24. The bitumen layer 22 has a first major surface 26 and a second major surface 28 that are each defined by the length and width of the bitumen layer 22. The release sheet 24 has a first major surface 30 and a second major surface 32 that are each defined by the length and width of the release sheet. The release sheet 24 is coextensive with or substantially coextensive with the first major surface 26 of the bitumen layer 22 and the first major surface 30 of the release sheet 24 is separably adhered to the first major surface 26 of the bitumen layer 22. The release sheet 24 enables the roofing component adhering assemblies 20 to be packaged and stored in roll form or in a stack with the first and second adhesive major surfaces 26 and 28 of the bitumen layer 22 from degradation due to exposure.

In FIG. 2, the roofing component adhering assembly is helically wound into a roll 34. With the roofing component adhering assembly 20 in its roll form, the first major surface 30 of the release sheet 24 is coextensive with and separably adhered to the first major surface 26 of the bitumen layer 22 and the second major surface 32 of the release sheet 24 is in contact with and substantially coextensive with the second major surface 28 of the bitumen layer 22. Preferably, the second major surface 32 of the release sheet 24 is more easily separated from the second major surface 28 of the bitumen layer 22 than the first major surface 30 of the release sheet 24 is separated from the first major surface 26 of the bitumen layer 22 to facilitate the dispensing of lengths of the roofing component adhering assembly 20 from the roll 34. The roofing component adhering assembly 20 of the roll 34 can be continuous and severed into selected lengths for application after selected lengths are unwound from the roll 34 or the roofing component adhering assembly 20 can be separable at spaced apart locations along its length into selected lengths (e.g. separable along transverse perforated lines or other transverse lines of weakness located at spaced apart locations along its length into selected lengths).

In FIG. 3, a series of the roofing component adhering assemblies 20 are stored in a stack 36. With respect to the roofing component adhering assemblies 20 within the stack 36, the first major surface 30 of each release sheet 24 is coextensive with and separably adhered to the first major surface 26 of a bitumen layer 22 of one roofing component adhering assembly within the stack and a second major surface 32 of each release sheet 24 within the stack is in contact with and substantially coextensive with the second major surface 28 of a bitumen layer 22 of another roofing component adhering assembly 20 within the stack 36. Preferably, the second major surfaces 32 of the release sheets 24 are more easily separated from the second major surfaces 28 of the bitumen layers 22 of the roofing component adhering assemblies within the stack than the first major surfaces 30 of the release sheets 24 are separated from the first major surfaces 26 of the bitumen layers 22 of the roofing component adhering assemblies within the stack to facilitate the dispensing of the roofing component adhering assemblies from the stack. A release sheet 38 is adhered to the second major surface 28 of the bitumen layer 22 of the lowermost roofing component adhering assembly 20 in the stack 36.

The roofing component adhering assembly 120 of FIGS. 4 and 5 includes a bitumen layer 122 and first and second release sheets 124. The bitumen layer 122 has a first major surface 126 and a second major surface 128 that are each defined by the length and width of the bitumen layer 122. The first and second release sheets 124 each have a first major surface 130 and a second major surface 132 that are each defined by the length and width of the release sheet. The first release sheet 124 is coextensive with or substantially coextensive with the first major surface 126 of the bitumen layer 122 and the first major surface 130 of the first release sheet 124 is separably adhered to the first major surface 126 of the bitumen layer 122. The second release sheet 124 is coextensive with or substantially coextensive with the second major surface 128 of the bitumen layer 122 and the first major surface 130 of the second release sheet 124 is separably adhered to the second major surface 128 of the bitumen layer 122. The release sheets 124 of the roofing component adhering assembly 120 protect the first and second adhesive major surfaces of the bitumen layer 122 from degradation due to exposure.

The bitumen layers 22 and 122 may have various lengths, widths and thicknesses. For example, the bitumen layers 22 and 122 may be from 0.5 inches to 1000 feet in length; from about 0.25 to about 40 inches in width; and from about 0.007 inches to about 0.375 inches in thickness. When the roofing component adhering assemblies 20 and 120 are used for adhering the overlapping end edge portions of cap sheets together, preferably, the bitumen layers 22 and 122 of the roofing component adhering assemblies have lengths about equal to or can be severed to lengths about equal to the widths of the cap sheets, e.g. about 40 inches; have widths between about 2.5 inches and about 6 inches; and thicknesses between about 0.007 inches and about 0.375 inches that enable the bitumen layer 22 or 122 to flow into the interstices of the granule surface of one of the end edge portions of the cap sheets being joined to ensure that the overlapping end edge portions of the cap sheets are securely adhered together with a watertight, weather-secure seam.

Preferably, the modified bitumen layers 22 and 122 of the roofing component adhering assemblies 20 and 120 are made of bitumen modified with styrene-butadiene-styrene polymer, styrene butadiene diblock polymer, hydrocarbon resins, oils, fillers, and additives. Preferably, the bitumen of the modified bitumen layers 22 and 122 has a penetration between 40 and 200 as measured by ASTM D-5 @ 25° C. and a Ring and Ball Softening Point between 20° C. and 70° C. as measured by ASTM D-36 that is typified by Phillips Conoco Wood River PG 58-22 bitumen. The styrene-butadiene-styrene polymer of the modified bitumen layers 22 and 122 is typified by a SBS polymer marketed by Polimieri Europa under the trade designation 161BE polymer and the styrene butadiene diblock polymer of the modified bitumen layers 22 and 122 is typified by a styrene butadiene diblock polymer marketed by Polimieri Europa under the trade designation 6320 polymer. Preferably, the oil of the modified bitumen layers 22 and 122 is a severely hydrotreated napthenic oil having a viscosity between 250 and 1000 Saybolt Universal Seconds when tested at 100° F. that is typified by Gardvis 2150 (Unimark) napthenic oil. Preferably, the hydrocarbon resin of the modified bitumen layers 22 and 122 is any C5-C9 hydrocarbon resin having a Ring and Ball Softening Point between 80° C. and 120° C. as measured by ASTM D-36 that is typified by Sunbelt SB 2296 hydrocarbon resin. Preferably, the filler of the modified bitumen layers 22 and 122 is an inorganic material such as limestone, dolomite, clay, or talc with a predominate amount passing a sieve of 40 to 200 mesh that is typified by Hubercarb 200. Preferably, the modified bitumen of the layers 22 and 122 includes various additives such as anti-oxidants typified by Anox 20 anti-oxidant from Great Lakes Chemical, and heat stabilizers.

A preferred composition of the modified bitumen of the layers 22 and 122 is as follows:

40% to 75% by weight bitumen having a penetration between 40 and 200 and a Ring & Ball Softening Point between 20° C. and 70° C.;

4% to 18% by weight styrene-butadiene-styrene polymer;

2% to 18% by weight styrene butadiene diblock polymer;

0.1% to 12% by weight severely hydrotreated napthenic process oil having a viscosity between 250 and 1000 Saybolt Universal Seconds when tested at 100° F.;

0.1% to 9% by weight C5-C9 hydrocarbon resin having a Ring and Ball Softening Point between 80° C. and 120° C.;

1% to 20% by weight filler; and 0.1% to 1% by weight antioxidant.

This preferred modified bitumen composition of layers 22 and 122 has a penetration between 40 and 120 as measured by ASTM D-5 @ 25° C. and a Ring and Ball Softening Point between 40° C. and 110° C. as measured by ASTM D-36.

Preferably, the release sheets 24 and 124 are made of bleached or unbleached paper, polyethylene films, polyester films, or polypropylene films that are treated on one or both surfaces with a release agent such as but not limited to silicone. The papers or films forming the release sheets 24 and 124 may be of various basis weights and thicknesses and have widths and lengths equal to or substantially equal to the widths and lengths of the bitumen layers 22 and 122 overlaid by the release sheets. The major surfaces of the release sheets 24 and 124 may be equally separable from the bitumen layers of the roofing component adhering assemblies 20 and 120 or one major surface of each release sheet 24 and 124 may be more easily separable from the bitumen layers of the roofing component adhering assemblies than the other major surface of each release sheet as discussed above in connection with the roofing component adhering assemblies 20.

FIGS. 6 to 9 show an example of a typical roofing installation 48 incorporating the roofing component adhering assemblies 20 of the subject invention. While the example of FIGS. 6 to 9 is described as using the roofing component adhering assemblies 20, the roofing component adhering assemblies 120 may be substituted for the roofing component adhering assemblies 20. As shown, the roofing installation 48 includes roof insulation boards 50, such as but not limited to high density, low thermal, rigid insulation boards. The insulation boards 50 are secured to a roof deck 52 by a bonding agent or fasteners and a layer of light weight, asphalt coated, base felts 54, e.g. fiber glass base felts, overlie and are adhered by an adhering layer 56 to the insulation boards 50. Cap sheets 58 overlie and are adhesively secured by an adhering layer 60 to the layer of base felts 54. The cap sheets 58 may be self-adhering cap sheets or may be adhered to the layer of base felts 54 by a cold-applied modified asphalt, roof ply adhesive layer or other appropriate adhesives. When the cap sheets 58 are applied over the layer of base felts 54, overlapping end edge portions 62 and 64 of the cap sheets and lateral edge portions 66 and 68 of the cap sheets 58 are bonded together to form an effective watertight, weather-secure seam. In FIG. 6 where one of the cap sheets 58 is shown peeled back, a bitumen layer 22, with the release sheet 24 removed, is shown bonded to the granule surface of the end edge portion 62 of one of the cap sheets 58 and another bitumen layer 22, with the release sheet 24 removed, is shown bonded to the lateral edge portion 66 of another of the cap sheets 58.

Figure 7:
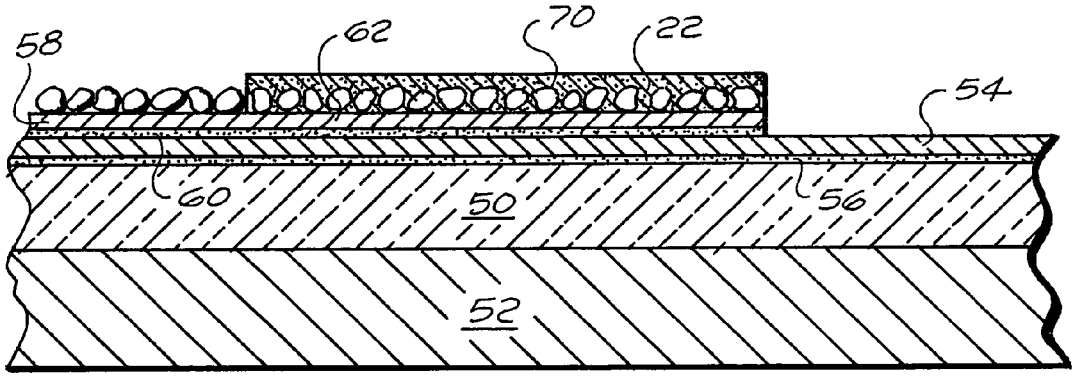
FIG. 7 is a cross section taken substantially along lines 7-7 of FIG. 6 and on a larger scale than FIG. 6 to better illustrate the invention.
Figure 8:
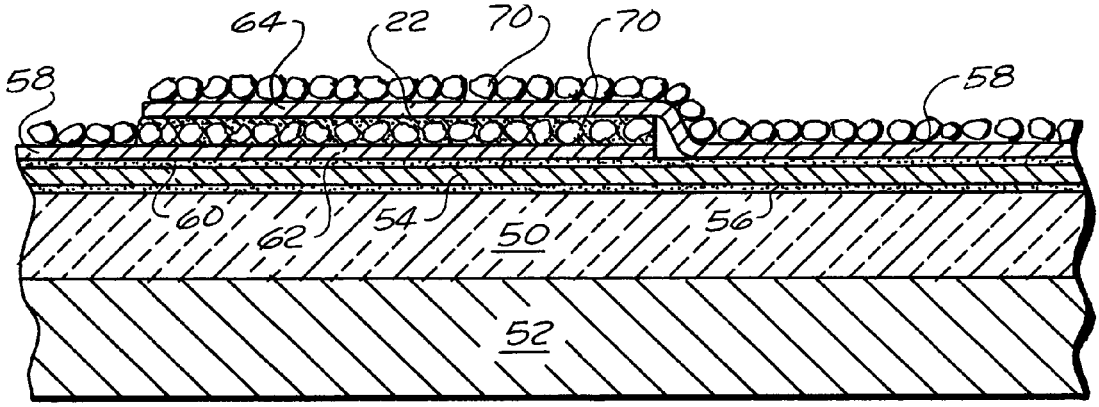
FIG. 8 is a cross section taken substantially along lines 8-8 of FIG. 6 and on a larger scale than FIG. 6 to better illustrate the invention.

As schematically shown in FIG. 7, which is taken substantially alone lines 7-7 of FIG. 6, when the bitumen layer 22 is applied to the upper granule surface of the end edge portion 62 of a cap sheet, the bitumen layer 22 is sufficiently thick to flow into the interstices between the granules 70 on the upper surface of the end edge portion 62 of the cap sheet 58 and still provide an adhesive surface for adhering to lower granule free surface of the overlapping end edge portion 64 of another cap sheet 58. FIG. 8, which is taken substantially along lines 8-8 of FIG. 6, shows a watertight, weather-secure seam formed between the upper granule surface of the end edge portion 62 of one cap sheet 58 and the lower granule free surface of an overlapping end edge portion 64 of another cap sheet 58.

Figure 9:
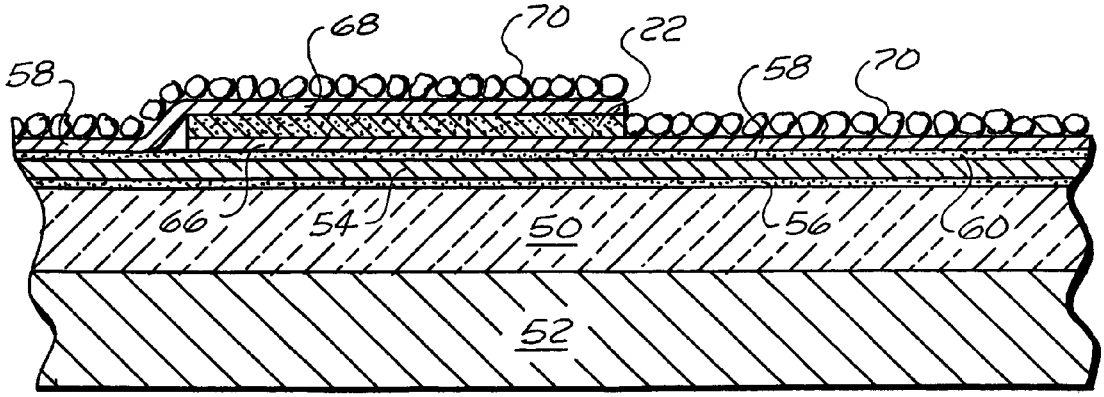
FIG. 9 is a cross section taken substantially along lines 9-9 of FIG. 6 and on a larger scale than FIG. 6 to better illustrate the invention.

The roofing component adhering assemblies 22 of the subject invention can also be used to adhere the lateral edge portions 66 and 68 of the cap sheets 58 together as well as for adhering the granule surfaces or granule free surfaces of end edge portions and lateral edge portions of other roofing sheets together. FIG. 9, which is taken substantially along lines 9-9 of FIG. 6, shows a watertight, weather-secure seam formed between the upper granule free surface of the lateral edge portion 66 of one cap sheet 58 and the lower granule free surface of an overlapping lateral edge portion 68 of another cap sheet 58.

In the preferred method of adhering overlapping portions of roofing components together with the roofing component adhering assemblies of the subject invention, a first roofing sheet, e.g. a first cap sheet 58, is adhered to an underlying layer of a built-up roofing system such as a layer of base felts 54. The first roofing sheet has a length and a width that define upper and lower major surfaces of the first roofing sheet. The major surfaces of the first roofing sheet have first and second end edge portions and first and second lateral edge portions such as the end edge portions 62 and 64 and the lateral edge portions 66 and 68 of the cap sheets 58. A second roofing sheet, e.g. a second cap sheet 58, is located on and adhered to an underlying layer of a built-up roofing system such as a layer of base felts 54. The second roofing sheet has a length and a width that define upper and lower major surfaces of the second roofing sheet. The major surfaces of the second roofing sheet have first and second end edge portions and first and second lateral edge portions such as the end edge portions 62 and 64 and the lateral edge portions 66 and 68 of the cap sheets 58.

Where a watertight, weather-secure seam is formed between end edge portions of the first and second roofing sheets, the second roofing sheet is located to have one of the end edge portions of the second roofing sheet and one of the end edge portions of the first roofing sheet in overlapping relationship. A roofing component adhering assembly 20 is selected having a bitumen layer 22 with a length equal to or substantially equal to the length of the overlapping end edge portions, a width equal to or substantially equal to the width of the overlapping end edge portions of the roofing sheets, and, where one or both of the end edge portion surfaces being joined is a granule surface, a thickness sufficient to flow into the interstices between the granules on the surface or surfaces to form a watertight, weather-secure seam between the overlapping end edge portions of the roofing sheets. The bitumen layer 22 of the roofing component adhering assembly is adhered to one of the overlapping end edge surfaces being joined, the release sheet 24 is removed from the bitumen layer 22, and lower surface of the overlapping end edge portion of the second roofing sheet and the upper surface of the overlapping end edge portion of the first roofing sheet are pressed and adhered together by the bitumen layer 22. FIG. 8 shows a watertight, weather-secure seam formed between the overlapping end edge portions 62 and 64 of cap sheets 58 by the preferred method of the subject invention.

Where a watertight, weather-secure seam is formed between lateral edge portions of the first and second roofing sheets, the second roofing sheet is located to have one of the lateral edge portions of the second roofing sheet and one of the lateral edge portions of the first roofing sheet in overlapping relationship. A roofing component adhering assembly 20 is selected having a bitumen layer 22 with a length equal to or substantially equal to the length of the overlapping lateral edge portions, a width equal to or substantially equal to the width of the overlapping lateral edge portions, and, where one or both of the lateral edge portion surfaces being joined is a granule surface, a thickness sufficient to flow into the interstices between the granules on the surface or surfaces to form a watertight, weather-secure seam between the overlapping lateral edge portions of the roofing sheets. The bitumen layer 22 of the roofing component adhering assembly is adhered to one of the overlapping lateral edge surfaces being joined, the release sheet 24 is removed from the bitumen layer 22, and lower surface of the overlapping lateral edge portion of the second roofing sheet and the upper surface of the overlapping lateral edge portion of the first roofing sheet are pressed and adhered together by the bitumen layer 22. FIG. 9 shows a watertight, weather-secure seam formed between the overlapping lateral edge portions 66 and 68 of cap sheets 58 by the preferred method of the subject invention.

While the preferred method of the subject invention is described as using the roofing component adhering assemblies 20, the roofing component adhering assemblies 120 may be substituted for the roofing component adhering assemblies 20 in the method of the subject invention.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of adhering together overlapping portions of roofing sheets of a built-up roofing system without the use of heat welding, hot asphalt, or liquid adhesive, comprising:

adhering a first roofing sheet to an underlying layer of a built-up roofing system; the first roofing sheet having a length and a width; the first roofing sheet having an upper major surface defined by the length and the width of the roofing sheet; the upper major surface of the first roofing sheet having first and second lateral edge portions and first and second end edge portions;

locating a second roofing sheet on and adhering a second roofing sheet to an underlying layer of a built-up roofing system; the second roofing sheet having a length and a width; the second roofing sheet having a lower major surface defined by the length and the width of the roofing sheet; the lower major surface of the second roofing sheet having first and second lateral edge portions and first and second end edge portions; the second roofing sheet being located to have one of the edge portions of the second roofing sheet and one of the edge portions of the first roofing sheet in overlapping relationship with the upper surface of the one edge portion of the first roofing sheet opposing the lower surface of the one edge portion of the second roofing sheet; the upper surface of the one overlapping edge portion of the first roofing sheet being a granule surface:

selecting a roofing component adhering assembly comprising a bitumen layer and a first release sheet; the bitumen layer having a length, a width and a thickness; the bitumen layer having a first major surface and a second major surface each defined by the length and the width of the bitumen layer; the length of the bitumen layer being substantially equal to a length of one of the overlapping edge portions; the width of the bitumen lever being substantially equal to a width of one of the overlapping edge portions; and the thickness of the bitumen layer being between 0.007 inches and 0.375 inches and sufficient to enable the bitumen layer to flow into the interstices formed by the upper granule surface of the one overlapping edge portion of the first roofing sheet to securely bond and seal the one overlapping edge portion of the second roofing sheet and the one overlapping edge portion of the first roofing sheet together, the first release sheet being substantially coextensive with the first major surface of the bitumen layer; the first release sheet having a first major surface and a second major surface; the first major surface of the first release sheet being in contact with the first major surface of the bitumen layer; and the first major surface of the first release sheet being separable from the first major surface of the bitumen layer, and adhering the lower surface of the one overlapping edge portion of the second roofing sheet to the upper surface of the one overlapping edge portion of the first roofing sheet with the bitumen layer of the roofing component adhering assembly flowing into the interstices formed by the upper granule surface of the one overlapping edge portion of the first roofing sheet to form a watertight, weather-secure seam by adhering the second major surface of the bitumen layer of the roofing component adhering assembly only to one of the opposing surfaces of the overlapping edge portions, removing the first release sheet from the first major surface of the bitumen layer of the roofing component adhering assembly, and adhering the first major surface of the bitumen layer of the roofing component adhering assembly only to the other of the opposing surfaces of the overlapping edge portions.

2. The method of adhering together overlapping portions of roofing sheets of a built-up roofing system according to claim 1, wherein:

the first roofing sheet and the second roofing sheet are cap sheets.

3. The method of adhering together overlapping portions of roofing sheets of a built-up roofing system according to claim 1, wherein:

the bitumen layer is a modified bitumen having a penetration between 40 and 120 and a Ring and Ball Softening Point between 40° C. and 110° C.

4. The method of adhering together overlapping portions of roofing sheets of a built-up roofing system according to claim 1, including:

supplying the roofing component adhering assembly from a helically wound roll of the roofing component adhering assembly; the second major surface of the first release sheet being in contact with and substantially coextensive with the second major surface of the bitumen layer; and the second major surface of the first release sheet is more easily seperated from the second major surface of the bitumen layer than the first major surface of the release sheet is separated from the first major surface of the bitumen layer to facilitate the dispensing of lengths of the roofing component adhering assembly from the roll.

5. The method of adhering together overlapping portions of roofing sheets of a built-up roofing system according to claim 1, including:

supplying the roofing component adhering assembly from a series of roofing component adhering assemblies in a stack; the second major surface of the first release sheet being in contact with and substantially coextensive with the second major surface of a bitumen layer of a second roofing component adhering assembly in the stack; and the second major surface of the first release sheet is more easily separated from the second major surface of the bitumen layer of the second roofing component adhering assembly than the first major surface of the first release sheet is separated from the first major surface of the bitumen layer of the first roofing component adhering assembly to facilitate the dispensing of the roofing component adhering assembly from the stack.

6. The method of adhering together overlapping portions of roofing sheets of a built-up roofing system according to claim 1, wherein:

the roofing component adhering assembly includes a second release sheet substantially coextensive with the second major surface of the bitumen layer; the second release sheet having a first major surface and a second major surface; the first major surface of the second release sheet being in contact with the second major surface of the bitumen layer; and the first major surface of the second release sheet being separable from the second major surface of the bitumen layer; and the second release sheet is removed from the second major surface of the bitumen layer prior to applying the second major surface of the bitumen layer to one of the opposing surfaces of the overlapping edge portions.

7. The method of adhering together overlapping portions of roofing sheets of a built-up roofing system according to claim 1, wherein:

the bitumen layer is a styrene-butadiene-styrene modified bitumen having a penetration between 40 and 120 and a Ring and Ball Softening Point between 40° C. and 110° C.; and the width of the bitumen layer is between 2.5 inches and 6 inches.

* * * * *